United States Patent [19]

Morfitt

[11] 4,345,742

[45] Aug. 24, 1982

[54] REGENERATIVE HYDRAULIC INTERLOCK SYSTEM

[75] Inventor: John B. Morfitt, Langley, Canada

[73] Assignee: Lantec Industries Ltd., Langley, Canada

[21] Appl. No.: 161,601

[22] Filed: Jun. 20, 1980

[51] Int. Cl.[3] ..... B66D 1/26

[52] U.S. Cl. ..... 254/291; 254/315

[58] Field of Search ..... 254/291, 297, 315

[56] References Cited

U.S. PATENT DOCUMENTS

| | | | |
|---|---|---|---|
| 3,346,237 | 10/1967 | Erickson et al. | 254/315 X |
| 3,963,217 | 6/1976 | Dwight | 254/315 |
| 4,058,295 | 11/1977 | Morfitt | 254/291 |
| 4,088,304 | 5/1978 | Gradert | 254/291 |

*Primary Examiner*—John M. Jillions

*Attorney, Agent, or Firm*—Seed, Berry, Vernon & Baynham

[57] ABSTRACT

A hydraulic yarding system in which the haulback and main drum are coupled to a primary drive motor and provided with a hydraulic interlock motor coupled to a planetary set in the haulback drive in an open loop hydraulic circuit. The hydraulic fluid from the interlock motor can be diverted to the hydraulic circuit for the primary drive motor through a pressure sequence valve and a directional valve. In this manner, regenerative driving of the interlock motor by the load pumps fluid from the interlock circuit selectively in the desired direction to the primary drive motor and supplements the power available to the primary drive motor. A preferred embodiment utilizes two pressure sequence valves in circuits to either the in-haul or out-haul fluid flow directions for the primary drive motor so that a diversion of fluid from the interlock circuit can occur at a lower pressure valve during out-haul.

6 Claims, 2 Drawing Figures

REGENERATIVE HYDRAULIC INTERLOCK SYSTEM

BACKGROUND OF THE INVENTION

1. Field of the Invention

This invention pertains to hydraulically powered yarder systems and particularly to hydraulically powered interlock systems where the pumps and motors operate in open loop circuits.

2. Description of the Prior Art

In conventional hydraulic open loop circuitry for logging yarders, the interlock motor on the haulback drum planetary gear set frequently becomes driven by the drum via cable load on the drum, causing the motor to act like a pump and create a fluid hydraulic backpressure which conventionally is passed through a relief valve back to the hydraulic reservoir. In closed loop hydraulic circuits, this cable load can act as a regenerative power source; but in open loop circuits, the hydraulic motor effectively serves as a braking device for maintaining tension on the cable between the haulback drum and the main drum with the energy supplied from the drum by being rotated by the cable load essentially being wasted or dissipated as heat in the hydraulic fluid.

SUMMARY OF THE INVENTION

It is an object of this invention to provide a regenerative open loop hydraulic system for supplementing the hydraulic power available in an open loop hydraulic circuit to the primary drive of the yarding system.

It is another object of this invention to provide a regenerative open loop hydraulic system which uses the rotational torque on the haulback drum caused by the load to provide, through an adjustable pressure control valve or valves, the excess pressurized fluid from the haulback interlock motor to the primary hydraulic drive while maintaining a desired tension setting in the cable system between the haulback and the main drums. Excess fluid for diversion can occur regeneratively from cable load as well as by fluid from the pump for the interlock motor, which may be in excess of that required by the interlock motor at any particular moment.

Powering of the haulback drum by the load can occur in many instances. In particular, when the diameter of the wraps on the haulback drum is large compared to the diameter of the wraps on the main line drum, such as when the carriage is reaching the tail block, the cable from the main drum tries to tension the cable to the haulback drum to make the haulback drum rotate at the same rotational velocity as the main drum. In this condition, the interlock motor is rotated via the planetary gear set and acts as a pump. Rather than divert the fluid exiting from the interlock motor to a pressure relief valve and then to reservoir, the fluid is diverted at a desired pressure through pressure sequence and directional valves to introduce the fluid back into the primary drive circuit for the main drum. This supplementary fluid will increase the speed of the yarder without increasing the load on the primary power source. A preferred embodiment utilizes two pressure sequence valves set at different pressures dependent upon whether the yarder is in an in-haul or an out-haul mode.

DETAILED DESCRIPTION OF THE PREFERRED EMBODIMENT

Figures 1, 1A:
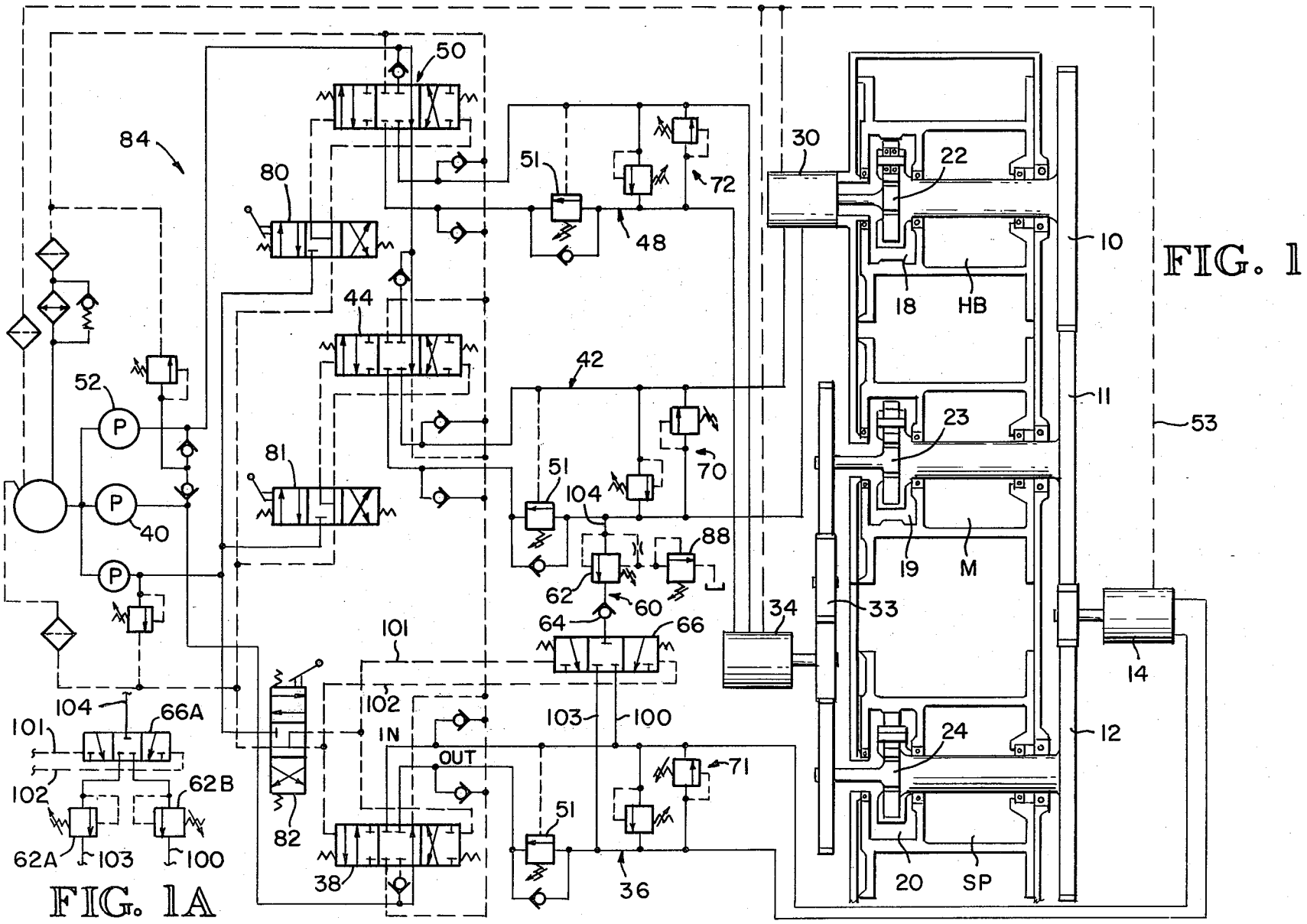
FIG. 1 shows a schematic yarder system embodying the principles of the invention.
FIG. 1A shows a preferred dual sequence valve embodiment.

A typical yarder system is illustrated in U.S. Pat. No. 4,058,295, a description of which is incorporated by reference thereto. In the typical system, there is a haulback drum HB, a main drum M and a slack pulling drum SP. Each of these drums is rotated by respective bull gears 10, 11 and 12 which are coupled together and driven from a primary drive motor 14. The shafts of the bull gears drive planetary carriers 18, 19 and 20, respectively. Each of the planetaries is provided with sun gears 22, 23 and 24 which in the preferred embodiments are coupled either to an interlock motor 30 or to a variable differential drive 33 driven by a drive motor 34. As is well known, the interlock motor 30 controls the speed and direction of rotation of the sun pinion in the haulback drum planetary gear set to compensate for the related changes in diameter of the wraps of wire on the haulback and main drum. The differential drive and drive motor 34 accomplish this function also, but in addition provide differential speed and rotational direction between the main and slack pulling drums for raising and lowering a log from a carriage. As thus far described, the yarder system is well known.

The primary drive motor 14 is powered by an open loop hydraulic circuit 36, the direction of the fluid of which is controlled by a primary control valve 38. Various combinations of hydraulic pressure can be provided to this primary hydraulic circuit, but in the preferred embodiment, a pump 40 driven from a conventional power source provides the hydraulic pressure for the circuit 36.

The haulback interlock motor 30 is powered by an open loop hydraulic circuit 42 which is controlled by a three-way pilot operated valve 44. Similarly, the slack pulling drive motor is controlled by an open loop hydraulic circuit 48 which is controlled by a three-way valve 50. Hydraulic pressure for the circuits 42 and 48 is provided by a second pump 52. In the preferred embodiment, both of the pumps 40 and 52 are driven from the common internal combustion engine or other primary power source.

Each of the primary, slack puller and interlock circuits is provided with conventional braking valves 51 and a common drain line 53 from the motors.

It is a unique feature of this invention that the hydraulic circuit 42 is coupled to a diversion circuit 60 which passes fluid through a pilot-operated adjustable pressure sequence valve 62, through a check valve 64 and thence to a three-position directional valve 66. Preferably, all of the directional valves illustrated are pilot pressure operated from slack puller, interlock and primary drive controls 80, 81 and 82 at a central control console 84. Suitable pressure relief valves 70, 71 and 72 are also provided to protect the respective circuits from excessive pressures.

In the preferred embodiment of FIG. 1A, the sequence and directional valves are rearranged and a second sequence valve is added. Otherwise the circuit remains as in FIG. 1. In this embodiment, line 104 goes to directional valve 66A, lines 101 and 102 connect to pilot lines, a low-pressure sequencer valve 62A, set for example at 2000 psi, connects to out-haul line 103 and a high-pressure sequence valve 62B (3000 psi) connects to in-haul line 100. In this embodiment, the supplementary fluid diversion during out-haul occurs at a lower interlock circuit pressure since less tension is needed during out-haul when the yarder is not carrying logs.

In operation the primary drive motor 14 will be operated either in the in-haul or out-haul direction for the carriage. The three-position directional valve 66A is piloted simultaneously with primary drive control valve 38 to shift to one of its two directional operating positions, whichever is consistent with the direction of the fluid in the primary circuit 36 to the primary drive motor. When the interlock motor 30 begins to be rotated as a pump and when the pressure in the line 42 exceeds the setting of the valve 62, or 62A or 62B, pressure will be diverted into the diversion circuit to supplement the fluid and pressure in the primary circuit 36. The setting of the adjustable pressure valve 62, or 62A or 62B, will be the desired tension pressure for the haulback drum, depending on the direction of carriage travel or yarding operation being performed, and, in one embodiment, can be set remotely by an adjustment valve 88. It is understood, of course, that diversion will not take place until the interlock motor pressure exceeds the pressure setting of the sequence valve or valves and the interlock circuit pressure exceeds the primary drive circuit pressure.

When the primary drive motor is not operating, the three-position directional valve is spring loaded to its neutral position, blocking flow from the interlock circuit. This allows higher interlock circuit pressure to be achieved so that higher haulback tension may be maintained while yarding laterally to the carriage.

While the preferred embodiment of the invention has been illustrated and described, it should be understood that variations will be apparent to one skilled in the art without departing from the principles here. Accordingly, the invention is not to be limited to the specific embodiment illustrated in the drawing.

I claim:

1. A regenerative hydraulically controlled interlock system for logging yarders capable of handling a load using open loop hydraulic circuits, comprising:

at least main and haulback drums and gear means continuously, commonly coupling said drums for mechanically driving said drums simultaneously;

primary drive means for powering said main and haulback drums simultaneously generally in opposite directions, said primary drive means including a motor in a primary open loop hydraulic power circuit;

hydraulic interlock drive means including an interlock motor coupled to said haulback drum for selectively varying the speed and/or direction of said haulback drum relative to the main drum;

a secondary open loop hydraulic power circuit coupled to said hydraulic interlock drive means, said hydraulic interlock drive means regeneratively producing pressurized hydraulic fluid to said secondary open-loop hydraulic power circuit when said interlock motor is driven by said load; and selective diversion means for selectively hydraulically coupling said secondary open loop hydraulic power circuit to said primary open loop hydraulic power circuit for supplementing said primary open loop hydraulic power circuit.

2. The system of claim 1, said diversion means including a three-position valve for diverting hydraulic fluid forward, reverse or blocking fluid and at least one pressureresponsive valve for setting the pressure at which the diversion means is activated.

3. The system of claim 1 wherein said diversion means includes two pressure-responsive valves, each set at a different diverting pressure and operable independently dependent upon the in-haul or out-haul directional mode of the primary power circuit.

4. The system of claim 2 or 3, including a slack pulling drum and drive means coupling said slack pulling drum to said primary drive means and a second variable differential drive for varying the speed and/or direction of the slack pulling drum relative to the main drum.

5. The system of claim 1, said diversion means including valve means for diverting hydraulic fluid in excess of the fluid needed by the hydraulic interlock drive means from said secondary open loop hydraulic circuit to said primary open loop hydraulic circuit to supplement the fluid in the primary open loop hydraulic power circuit.

6. A regenerative, hydraulically controlled interlock system for logging yarders capable of handling a load using open-loop hydraulic circuits, comprising:

at least main and haulback drums and gear means continuously, commonly, drivingly coupling said drums for mechanically driving said drums simultaneously;

primary drive means for powering said main and haulback drums simultaneously, generally in opposite directions, said primary drive means including a motor;

hydraulic interlock drive means including an interlock motor coupled to said haulback drum for selectively varying the speed and/or direction of said haulback drum relative to the main drum;

a primary open-loop hydraulic power circuit coupled to said primary drive means for providing pressurized primary hydraulic fluid to said primary drive means;

a secondary open-loop hydraulic power circuit coupled to said hydraulic interlock drive means, said hydraulic interlock drive means regeneratively producing pressurized hydraulic fluid to said secondary open-loop hydraulic power circuit when said interlock motor is driven by said load; and selective diversion means for selectively hydraulically coupling said secondary open-loop hydraulic power circuit to said primary hydraulic power circuit for supplementing said primary hydraulic power circuit, each said open-loop hydraulic power circuit having a reservoir, a unidirectional, fixed displacement pump, a hydraulic motor, a directional control valve between the pump and motor to control the direction of the motor, an input line to the pump from the reservoir and a discharge line back to the reservoir, said selective diversion means operable to divert hydraulic fluid from said secondary open-loop hydraulic power circuit to said primary hydraulic power circuit between said fixed displacement pump and said hydraulic motor of said primary hydraulic power circuit.

* * * * *